US005984309A

United States Patent [19]

Santin

[11] Patent Number: 5,984,309

[45] Date of Patent: Nov. 16, 1999

[54] SWEEPSTAKES POKER

[75] Inventor: Frank Santin, Huntington Beach, Calif.

[73] Assignee: Michael A. Meczka, Los Angeles, Calif.

[21] Appl. No.: 09/062,762

[22] Filed: Apr. 20, 1998

[51] Int. Cl.[6] ..... A63F 1/00

[52] U.S. Cl. ..... 273/292

[58] Field of Search ..... 273/292, 274, 273/309; 463/12, 13

[56] References Cited

U.S. PATENT DOCUMENTS

| | | | |
|---|---|---|---|
| 5,265,882 | 11/1993 | Malek | 273/292 |
| 5,288,082 | 2/1994 | Marquez | 273/292 |
| 5,294,128 | 3/1994 | Marquez | 273/292 |
| 5,314,194 | 5/1994 | Wolf | 273/292 |
| 5,322,295 | 6/1994 | Cabot et al. | 273/292 |
| 5,411,268 | 5/1995 | Nelson et al. | 273/292 |
| 5,531,440 | 7/1996 | Dabrowski et al. | 273/292 |
| 5,580,061 | 12/1996 | Kong | 273/292 |
| 5,584,486 | 12/1996 | Franklin | 273/292 |
| 5,678,821 | 10/1997 | Hedman | 273/292 |

OTHER PUBLICATIONS

Split Em Up Copyright Aug. 17, 1992 Author Frank Santin.

*Primary Examiner*—Benjamin H. Layno
*Attorney, Agent, or Firm*—Nathan Boatner

[57] ABSTRACT

A novel card game wherein each player forms a front hand and a back hand with wagers made on the front hand and back hand with a wager made for a sweep pool bet. The front hands of all players are compared to each other using the ranking rules of regular poker to determine the front hand winner. The back hands of all players are compared to each other also using the ranking rules of regular poker to determine the back hand winner. Any player who makes a sweep pool wager and also wins both the front hand and the back hand on any one distribution of cards wins the total amount in the sweep pool or if there is no sweep pool winner then all sweep pool wagers are added to the prior amount of the sweep pool.

6 Claims, 1 Drawing Sheet

SWEEPSTAKES POKER

BACKGROUND OF THE INVENTION

1) Field of the Invention

This invention relates to card games of chance and more particularly to a new method of playing a card game using the general rules of poker to evaluate each hand in the game.

2) Description of the Prior Art

The game of poker has many variations at present such as five card stud poker, seven card stud poker, Texas hold-em poker, and the like. The rules of poker are applied to each variation of the basic game of poker to evaluate each hand in each of the poker game variations. Most variations of poker consist of five cards or selection of five cards from seven cards that are dealt to each player and available to each player at each hand. Variations of poker also include the game of Pai Gow poker with many variations on the way basic Pai Gow poker can be played.

Poker games are not only popular among social groups or even among family members but are also played at casinos throughout the world. Casino card game play usually involves the game known as 21 or blackjack. Many recent variations of this game have recently been patented and many of these variations of the basic game of 21 are now being played in casinos. For a card game to be played at a casino the game must be simple and yet challenging to the player. One objective of card games played at a casino is that the card game be played quickly so as to tend to maximize the income derived from the playing of the game by the casino or what is called in game vernacular the house.

The game of 21 is relatively well suited for general play at gambling casinos in that it usually involves each player being dealt five cards or less by a house dealer with each player making wagers against the house player or dealer. The basic rules for the playing of the game of 21 are simple and each hand of the game can be quickly played at a casino. If the player in the game of 21 is dealt cards that total in point count that is closer in point count to 21 than the card point count of the dealer then the player wins the hand. If the dealer has a card point count in a hand closer to 21 than that of any player then the dealer wins that hand. There are other relatively simple rules that also govern play of this game but the important goal of each hand is for the player to have a card hand that is closer to 21 than the card hand of the dealer.

In some states such as California casino card play is legal for wagers made by players. However, some identified card games are illegal in California and other states for play in casinos. The game of 21, for example, is illegal for play in casinos in the State Of California. Card playing for money at casinos is legal for the simple reason that individuals will play certain card games for money at card rooms or the like even if made illegal by statute. Statutory law simply cannot legislate morality or cannot prohibit certain activities of persons that appear to be ingrained into the human psyche and the playing of card games for money appears to be such an activity.

Because the game of 21 is illegal for casino play in California similar games have been invented and are being played at casinos in California. Variations of the basic game of 21 include each player being dealt multiple hands such as two hands for the basic game of 21 or enough cards to form two hand each time the dealer distributes cards to all players at a wagering table. Another popular version of the basic game of 21 is the game of 22 now being played in many casinos in California where each player attempts to combine cards so that the point count total of each hand is as close to 22 as possible.

Casinos obtain their revenue from the playing of cards by taking a set amount or percentage from each pot on each hand in many poker type games. Casinos can also obtain revenue by requiring each player to pay a certain amount of seat rental in a game. In point count games such as in the game of 21 the casino usually has a dealer who plays for the house against each other player according to the rules of 21 and the house odds are slightly better than the odds for an individual player so the casino obtains revenue in this manner as well.

Most card games at casinos are similar to the basic game of 21 in that these games involve a point count on each hand in order to determine which player is the winner and which players are the losers on each hand played. In a point count game the number cards in a regular card deck have their number count and face cards each count 10 for arriving at the total point count for each hand. This kind of game is played relatively quickly at a casino which permits the casino to maximize its revenue from each hand or each game, whereas poker hands such as seven card stud poker are played relatively slowly at the casino and are less popular for that reason among persons who patronize card rooms and casinos where card games are played.

The basic rules of regular poker assign rank values to each hand based on the odds of achieving such a hand. For example a straight flush is the best hand unless a joker is used in which case five of a kind would be the best hand. Next four of a kind beats a full house hand consisting of a five card hand with three of a kind and also two or a kind or a pair. Then a five card flush beats a five card straight which beats three of a kind which beats two pairs in one hand which beats one pair. If there are ties such as if there are two five card straits between two players of any one hand then the higher in rank straight beats the lower in rank straight.

A method of playing a card game between the house and players using both the point count rules of the game of 21 and the basic rules of poker is described in U.S. Pat. No. 5,678,821 by Hedman. This game also has an optional progressive jackpot bet. This is a three handed game and is relatively complex especially since the players must use the point count method of identifying the winning hand and the card ranking method of regular poker.

A variation of the basic game of 21 is described by Marquez in U.S. Pat. No. 5,288,082 in which game each player has two distinct hands for evaluation using the basic card point count method. Each player is dealt a front hand and a back hand compared to the front hand and the back hand of a dealer or house player.

Wolf in U.S. Pat. No. 5,314,194 describes a game wherein each player has a first and a second hand ranked by the rules of ordinary poker with a complex wagering process. The winner in this game is determined by whomever wins both the first hand and the second hand.

Cabot in U.S. Pat. No. 5,322,295 describes a multiple hand card game in which wagers are made on each card dealt as opposed to a wager on each hand dealt. Hands are evaluated using the basic point card count method in order to determine the winning hand.

Franklin in U.S. Pat. No. 5,584,486 describes a complex game wherein each player is dealt seven cards and from the seven cards forms a high hand and a low hand using the rules of regular poker to rank the hands. When the player forms a low hand that is lower than the low hand of the dealer or house player and a high hand that is higher in rank that the high hand of the dealer then that player wins the hand. Another feature of this game is that if any player makes an optional jackpot wager on any hand and is also dealt a predetermined seven card jackpot holding.

SUMMARY OF THE INVENTION

There is a long felt need for a game based on the basic rules of poker that can be quickly played at casinos. This game would give the patron of the casino an alternative to the game of 21 or its variations provided that the poker game could be played quickly and would be simple and easy to learn to play and to play. This is the principal objective of the present invention. That is, to introduce a novel game based on the rules of poker with all of the advantages for casino playing of the game of 21 and other point count games that are similar to the game of 21. Such a novel game as is the present invention would be and is simple to play, easy to learn, and is played relatively quickly.

Another objective of the present invention is to present a novel game that has a jackpot feature. This is part of the present invention in that each player on each hand can make a sweep pool bet with the sweep pool being the jackpot payoff provided that the player makes a sweep pool wager on any one hand.

The present game is relatively simple but has depth of play as well. It is well suited for play at the casino because of this.

In simple form the game is played by a dealer distributing seven cards to each player. Each player then forms a front hand with, for example, two cards, and a back hand with, for example, five cards. The player with the highest front hand compared to the front hands of all other players wins the front hand wager. The player with the highest back hand compared to the back hands of all other players wins the back hand wager. If any one player makes a sweep pool bet and that same player wins both the front and the back hands on any one play of the game that player also wins the sweep pool. The house or casino would obtain revenue from this game by taking a set amount from each hand dealt or by using any other method of charging the patron for playing of the game.

IN THE DRAWING

DESCRIPTION OF THE PREFERRED EMBODIMENT

Figure 1:
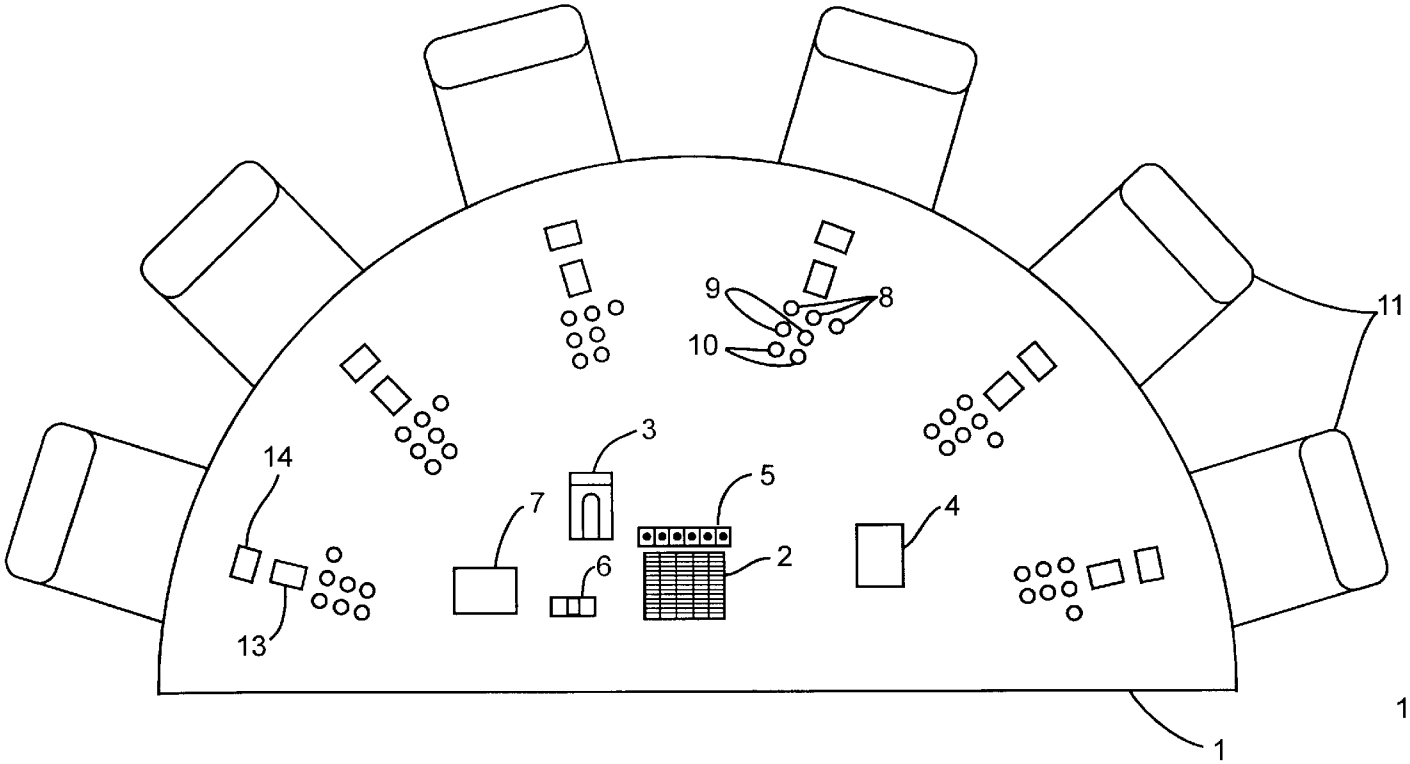
FIG. 1 is a top view of a typical table layout for the playing of the game.
Figure 2:
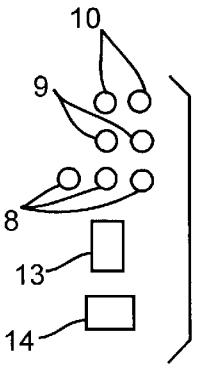
FIG. 2 is a detailed view of the wagering spots available to each player.

In simple form the game is played by each player being distributed seven cards by a dealer or game supervisor. The seven cards can be distributed with a device such as a game shoe 3 or any mechanical card shuffling device. The seven cards distributed to each player are distributed from a card deck consisting of 52 regular cards and one joker which is a wild card. The joker can either be a completely wild card or can represent a choice of cards such as either aces, or a card of any one suit or the like. It is usual practice for there to be a discard tray 4 at the casino.

Since there would be seven cards distributed to each player the maximum amount of players in player seats 11 would be seven. Each player plays a front hand 13 consisting for example of two cards; and a back hand 14 consisting of for example five cards. The dealer could either deal the cards to the front hand and back hand areas on the playing surface or the dealer could deal all seven cards to each player and the player would then form a front hand and a back hand. The players play their front hands against the front hands of all other players and the back hands against the back hands of all other players. There is a front hand winner and a back hand winner for each hand or perhaps there might be a tie hand in which case the pot for that hand would be equally divided among the players who have tie hands.

The hands are ranked using the rules of regular poker. For example, in a two card hand the winning hand would be a pair or absent any player having a pair the winning hand would be the hand with the highest card in rank such as an ace. Flushes and straights would not be counted in the two card hand, but would be counted in the five card back hand.

Initial wagers for the front hand and the back hand would be made prior to any cards being distributed. In the alternative the dealer could distribute the cards to each player and then each player could make a front hand or a back hand wager or both. The other players then would have the option of covering the bets in this alternative mode of play. For each distribution of cards by the dealer any player has the option of making a sweep pool bet in one mode of play. In all modes of play, however, there must be means for building a sweep pool or jackpot. If the player wins both his or her front hands and back hands and also makes the optional sweep pool bet then that player would win the sweep pool. The sweep pool amounts to all sweep pool wagers made when the player failed to win the sweep pool. Chips made on the unsuccessful sweep pool wagers would be added to the sweep pool and could be kept in a sweep pool spot 7.

The usual playing surface 1 is straight in back for the dealer area and curved in front for the seating of players. Usually there would be a chip rack 2 and a drop slot 6 on each table layout at a casino. A house spot for each player 2 would keep track of how much each individual player owes the house for the privilege of playing the game.

A typical table layout would have wagering spots 8 for initial wagers to be made prior to any cards being distributed. A variation of the basic game would be for there to be additional wagering spots for chips wagered in a second wager for either or both front hands and back hands 9 and with additional wagering spots for a third wager 10 on either the front or back hands or both. These additional wagers by any one player would require a like additional wager by at least one or more additional players to be won or lost by any player. In the event of a tie hand each player would receive an equal share of the total amounts wagered on any one hand.

In addition to the above methods of play of this game there exist three basic variations of the play of the game, namely; 1) with an optional sweep pool wager for each player; 2) with at times a mandatory sweep pool wager and at time an optional sweep pool wager; and 3) with at all times a mandatory sweep pool wager by all players.

In the first variation with a sweep pool bet being placed at the option of any player, there must be some means of providing an amount to be won with the sweep pool wager so as to give the player an incentive to make the optional wager. For example if some player wins the sweep pool wager then the sweep pool would be empty and a player would have no incentive to make an optional sweep pool wager in that nothing could be won and the wager itself could be lost. Also the sweep pool would be empty at the start of any game.

In order the provide winnings from a sweep pool bet the casino or house could put some amount into the sweep pool after the sweep pool is empty. This amount could be obtained by the casino or house from charges made each player to play the game itself or from a cut by the house of each pot won by each player who wins only a front hand or only a back hand. Under these conditions the players would then have an incentive to make an optional sweep pool bet.

Another variation of basic play of the game would be for the sweep pool bet to be mandatory in some unit amount for each time the dealer distributes the cards for any one play of the game. This would eventually build up a sweep pool that would give the player an incentive to make the sweep pool wager.

The sweep pool bet could be either mandatory at times and then optional at times. For example at the start of each game or after a player wins the sweep pool one sweep pool bet would be mandatory for each player. This one mandatory sweep pool bet is contemplated to be two betting units in order for the sweep pool wager to be an even money bet after the sweep pool is emptied. Also in order for any new player to enter the game it is contemplated that the new player would be required to made a suitable contribution to the sweep pool which would be determined by appropriate house rules such as a mandatory bet of the amount in the sweep pool divided by the total number of players or the like. Another variation of the game would be that no new player could enter the game until just after one player wins the sweep pool bet. Then that new player would only be required to bet two units to be make the sweep pool an even money bet for all players. After that one mandatory sweep pool wager each player would then have the option to make the sweep pool bet. This both mandatory and optional sweep pool wagering method of play of the game is contemplated to be the preferred method of play of the game.

Payoff of the sweep pool wager is contemplated to be a winner take all payoff, but alternative payoff methods are conceivable. For example the sweep pool winner could receive only a percentage of the sweep pool. Another alternative would be for the sweep pool winner to receive a percentage of the sweep pool and any other player who made a sweep pool wager on the same distribution of cards by the dealer would get a smaller percentage of the sweep pool.

The above description of the preferred embodiment of the invention is for purposes of illustration only and not for purposes of limiting the scope of the invention. The scope of this invention is intended to be limited to the following claims and their equivalents and not by the above description and drawings.

What is claimed is:

1. A method of playing a card game played using the rules of regular poker to rank the value of each hand using a deck of 52 regular cards comprising the steps of:

a card dealer distributing cards to each player but does not engage in play of the game;

each player making a front hand wager and a back hand wager prior to any cards being distributed;

providing a sweep pool;

each player optionally making a sweep pool wager;

each player then playing a front hand and a back hand;

after each players front hands and back hands are formed, comparing the front hands of all players to determine the front hand winner and comparing the back hands of all players to determine the back hand winner;

if any player making a sweep pool wager wins both the front hand and the back hand on any one distribution of cards that player wins the total amount of the sweep pool; and if there is no sweep pool winner then all sweep pool wagers are added to the total amount of the sweep pool.

2. A method of playing a card game as described in claim 1 wherein the card deck consists of 52 regular cards and one or more wild cards.

3. A method of playing a card game described in claim 1 wherein the dealer distributes exactly seven cards to each player.

4. A method of playing a card game described in claim 1 wherein the front hand of each player consists of exactly two cards and the back hand of each player consists of exactly five cards.

5. A method of playing a card game described in claim 1 wherein each player may make additional wagers after the cards are distributed by the card dealer;

other players may match the additional wagers made by any player if desired; and the winner of either the front hand or back hand would also win any additional wagers if made by other players.

6. A method of playing a card game described in claim 1 wherein the means to provide a sweep pool are comprised of one mandatory sweep pool wager being required of each player of the game in the event that the sweep pool is empty for any reason; and any later sweep pool wagers would be optional for any player.

* * * * *